United States Patent [19]

Wilson et al.

[11] Patent Number: 4,808,118

[45] Date of Patent: Feb. 28, 1989

[54] RETENTION AND GROUND PLANE CONNECTOR CLIP

[75] Inventors: Albert H. Wilson, Los Angeles; David E. Welsh, Tustin, both of Calif.

[73] Assignee: ITT Corporation, New York, N.Y.

[21] Appl. No.: 125,276

[22] Filed: Nov. 25, 1987

[51] Int. Cl.[4] ..... H01R 9/00

[52] U.S. Cl. ..... 439/95; 439/607

[58] Field of Search ..... 439/607-610, 439/744, 745, 871; 333/182, 183

[56] References Cited

U.S. PATENT DOCUMENTS

| | | | |
|---|---|---|---|
| 3,825,874 | 7/1974 | Peverill | 439/608 X |
| 4,020,430 | 4/1977 | Vander Heyden . | |
| 4,265,506 | 5/1981 | Hollyday . | |
| 4,371,226 | 2/1983 | Brancaleone . | |
| 4,407,552 | 10/1983 | Watanabe et al. . | |
| 4,519,665 | 5/1985 | Althouse et al. . | |
| 4,601,527 | 7/1986 | Lemke | 439/608 X |
| 4,606,598 | 8/1986 | Drzymkowski et al. . | |
| 4,624,515 | 11/1986 | Brush, Jr. et al. | 439/608 X |
| 4,647,122 | 3/1987 | Kelly . | |
| 4,660,907 | 4/1987 | Belter . | |
| 4,679,013 | 7/1987 | Farrer et al. | 333/182 |

*Primary Examiner*—Paul Gensler

*Attorney, Agent, or Firm*—Thomas L. Peterson

[57] ABSTRACT

A metal clip is described which retains a modular insert containing an insulator body with contacts thereon, in a shell of a connector, while also providing a ground plane and shield against electromagnetic interference. The clip includes a flat middle portion that extends across most of the width of the connector and a pair of opposite ends bent out of the plane of the middle portion and having edges that abut shoulders formed on the shell and that press against shell surfaces lying adjacent to the shoulders. The flat middle portion lays facewise against a face of the insulator body of the connector to prevent movement of the insulator body and contacts therein. The middle portion of the clip spans most of the area within the shell to provide an electromagnetic shield that is electrically terminated to the shell.

11 Claims, 4 Drawing Sheets

RETENTION AND GROUND PLANE CONNECTOR CLIP

BACKGROUND OF THE INVENTION

One type of connector has a shell of rectangular cross section which surrounds a modular insert containing a body of insulative material and multiple contacts mounted on the body. A ground plane is sometimes necessary, which is connected to the shell, to provide electromagnetic interference shielding when the connector is unmated from another connector. The ground plane also facilitates the termination of filter pin or electromagnetic pulse dissipating contacts. The modular insert not only must be securely held within the shell, but must be able to "float" or shift position laterally by perhaps 0.010 inch to enable the contacts to shift position during mating with contacts of another connector. A simple means for retaining an insulative body of a connector within a shell, especially a modular insert, which also provided an electromagnetic shield and ground plane connected to the shell, which enabled "floating" of the insert relative to the shell, and which enabled the easy removal of the insert from the shell and its replacement, would be of considerable value.

SUMMARY OF THE INVENTION

In accordance with one embodiment of the present invention, a clip is provided that holds an insulative body within a connector shell. The clip has a middle portion lying substantially facewise against the insulative body and has ends bent out of the plane of the middle portion and forming edges that abut shoulders at opposite sides of the connector shell. The bent ends of the clip are preloaded against the shell walls that lie adjacent to the shoulders, and can be deflected away from the shell shoulder for removal of the insulative body.

The clip can extend across most of a cross sectional space within the shell to serve as an electromagnetic interference shield when the connector is unmated from another connector. The bent clip ends make electrical contact with the shell near where the clip ends abut the shell shoulder. The clip allows the insulative body and the contacts mounted therein to "float" so as to move laterally by a small amount which is necessary during mating of a pair of connectors. The clip can be permanently installed in an insert module which includes the insulative body and contacts therein, for rapid mounting in a shell or withdrawal therefrom.

The novel features of the invention are set forth with particularity in the appended claims. The invention will be best understood from the following description when read in conjunction with the accompanying drawings.

DESCRIPTION OF THE PREFERRED EMBODIMENT

Figure 1:
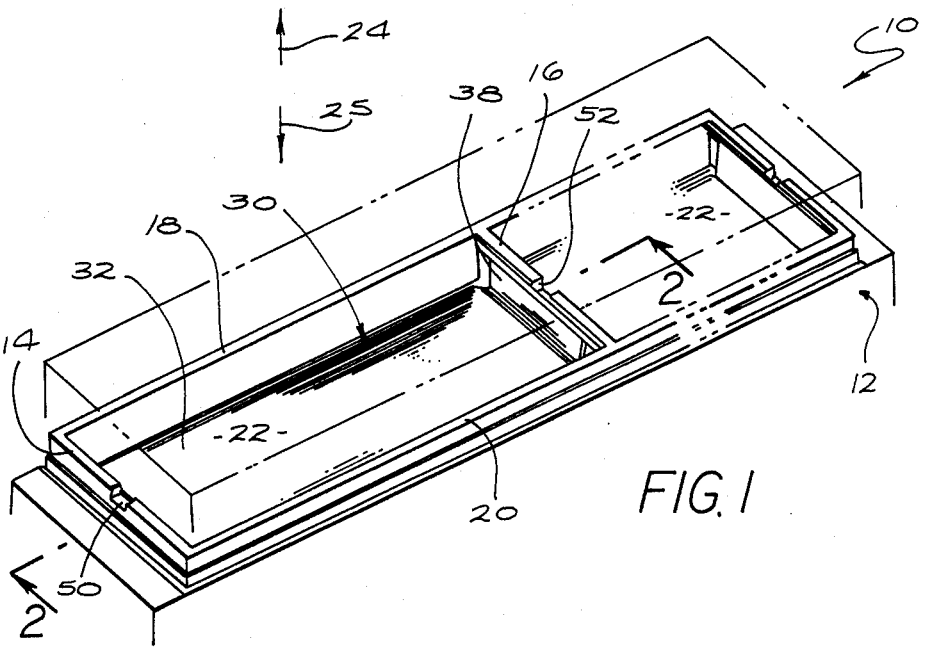
FIG. 1 is a partial perspective view of a connector constructed in accordance with the present invention.
Figure 2:
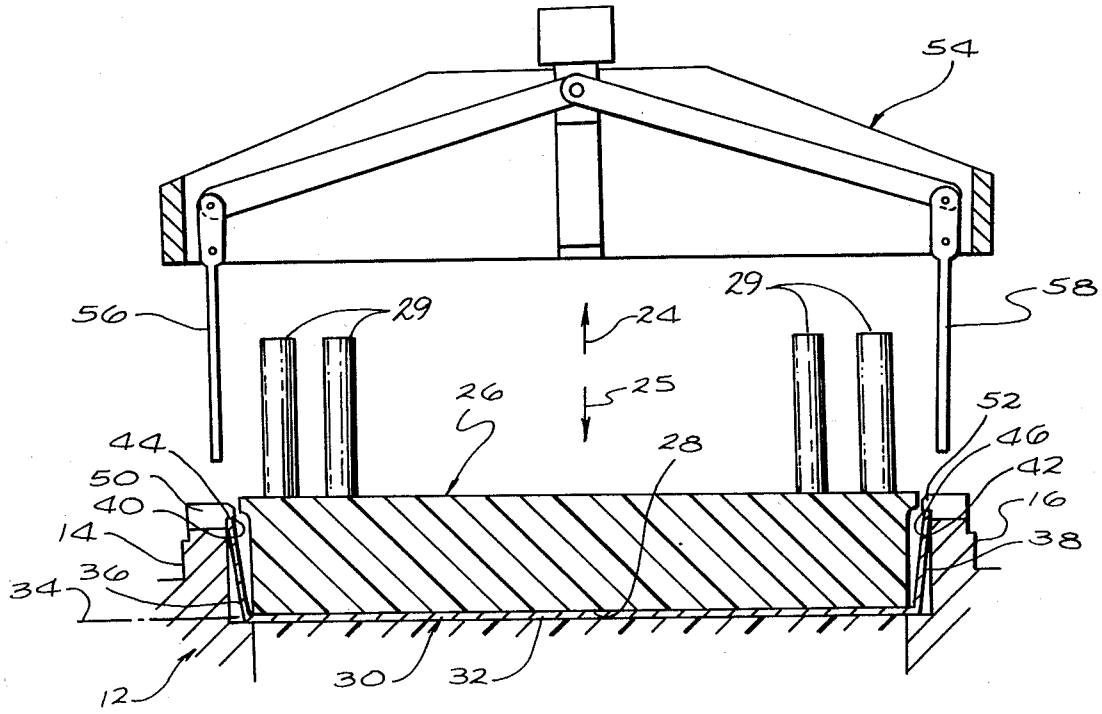
FIG. 2 is a view taken on the line 2—2 of FIG. 1, and also including a sectional view of a removal tool.

FIG. 1 shows a connector 10 which includes a shell 12 of rectangular shape, which has pairs of opposite short sides 14, 16 and a pair of opposite longer sides 18, 20. The shell forms a space 22 of rectangular cross sectional area when viewed along a forward direction 24, or rearward direction 25, along which the connector respectively mates and unmates from a corresponding second connector. These directions each may be referred to as mating-unmating directions, or as vertical directions (when the connector is in the illustrated orientation with its opposite sides horizontally spaced). The particular shell has several of such spaces 22 that each can hold a module containing numerous contacts. As shown in FIG. 2, the connector includes a body 26 of electrically insulative material having a substantially flat rearward face 28 and a plurality of electrical contacts 29 held in the insulative body and which can mate with corresponding contacts on another connector.

A clip 30 formed of sheet metal extends between opposite sides 14, 16 of the shell. The clip has a substantially flat middle portion 32 which lies in a plane 34 and facewise against the rearward body face 28. The clip also has a pair of opposite ends 36, 38 that are bent out of the plane 34. The shell forms a pair of shoulders 40, 42 facing in the rearward direction 25. The ends of the clip form edges 44, 46 that abut the shoulders 40, 42, at least when the clip is pulled in the forward direction 24. It is possible to embed the clip in the insulator body.

The shell 12 includes slots 50, 52 at its opposite sides 14, 16, that extend across locations otherwise occupied by the shoulders 40, 42. Each slot extends rearward (direction 25) of the corresponding shoulder 40, 42. This allows a removal tool 54 to be positioned with a pair of elements 56, 58 against the opposite ends 36, 38 of the clip. The elements 56, 58 can be moved together to deflect the clip ends inwardly off the shoulders 40, 42 to release the clip from the shoulders so that it and parts attached to can be removed from the shell 12.

Figure 3:
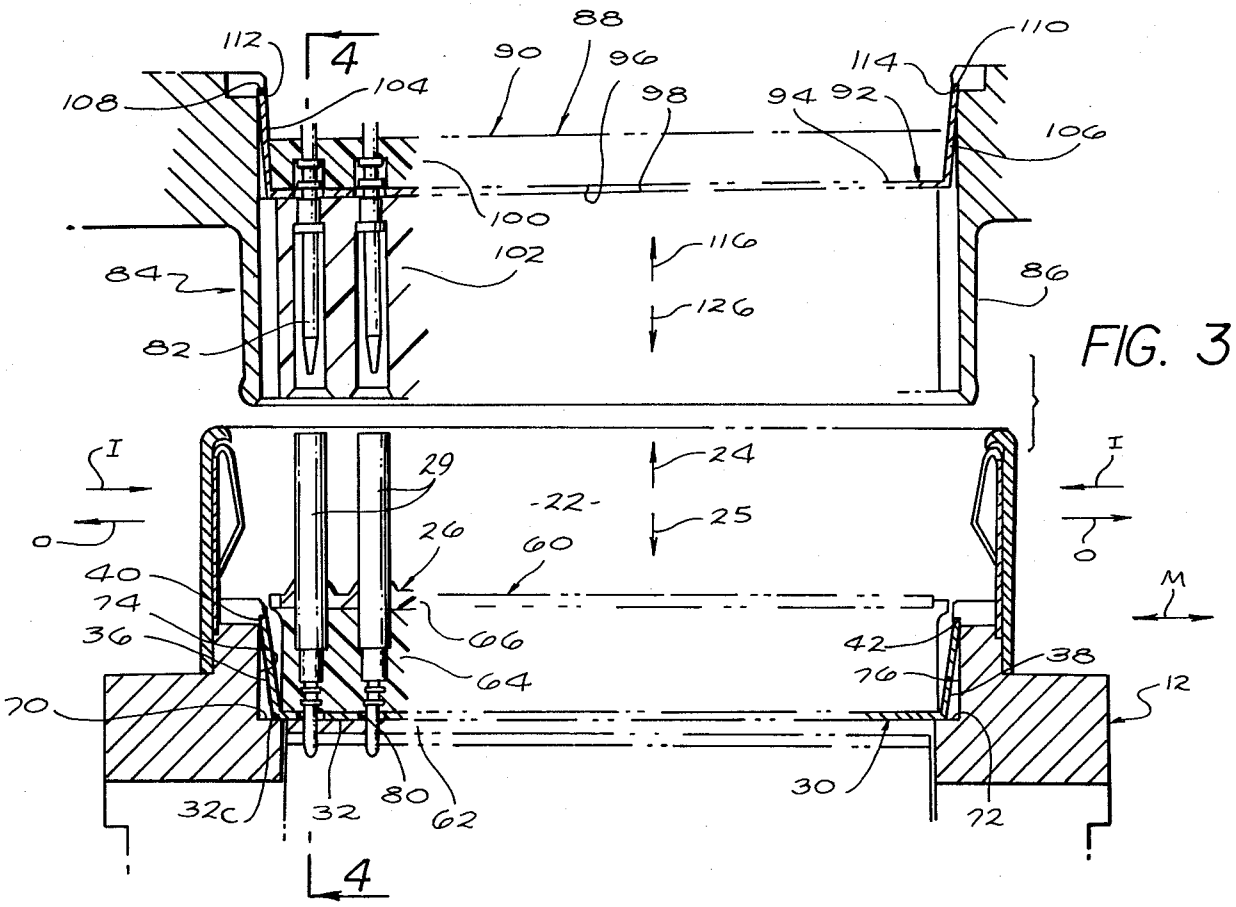
FIG. 3 is a more detailed sectional view of the connector of FIG. 2, shown with another mating connector in proximity thereto.

As shown in FIG. 3, the insulative body 26 and contacts 30 can form part of an insert module 60 that can be readily removed and replaced from the shell 12. The insulative body 26 of the insert module includes several insulative layers 62, 64, 66 which are bonded to one another and to the clip middle portion 32. To insert the module 60 into the shell 12, wires or other termination means (not shown) connected to the rearward ends of the contacts 30 are passed through the space 22, and the module 60 is pressed rearwardly until the clip ends 36, 38 snap into position behind the shoulders 40, 42 of the shell. The shell also forms a pair of forwardly-facing shoulders 70, 72 lying rearward and inward (in the direction of arrows 25 and I) of the forward shoulders 40, 42. The end portions **32*c* of the clip middle portion rest against the shoulders 70, 72** to limit rearward movement of the module. Thus, the clip holds the module within the shell, preventing both forward and rearward movement of the module to hold it in place, and yet the clip ends can be moved together to readily release the module from the shell. When the module is replaced, the clip (as part of a new module) is also automatically replaced.

The clip 30 provides an electrically grounded plane or ground plane, covering most of the cross sectional area of the space 22 within the shell. The ends 36, 38 of the clip form spring fingers that are preloaded so they tend to flex in an outward direction indicated by arrows O against clip-engaging surfaces 74, 76 of the shell that lie immediately below, or rearward, of the shoulders 40, 42. The shell 12 is, in the usual practice, electrically grounded. The fact that the middle portion 32 of the clip extends over most of the space 22 of the shell, results in the clip serving as an EMI (electromagnetic interference) shield that limits the induction of unwanted interference in the wires leading to the contacts 30 when the connector 10 is unmated from another connector and therefore the space 22 is open. It may be noted that the clip middle portion 32 has numerous perforations 80 around the contacts 30 to avoid grounding of the contacts (except for those contacts which are intentionally grounded as by providing a solder connection between the contact and the clip middle portion).

Figure 4:
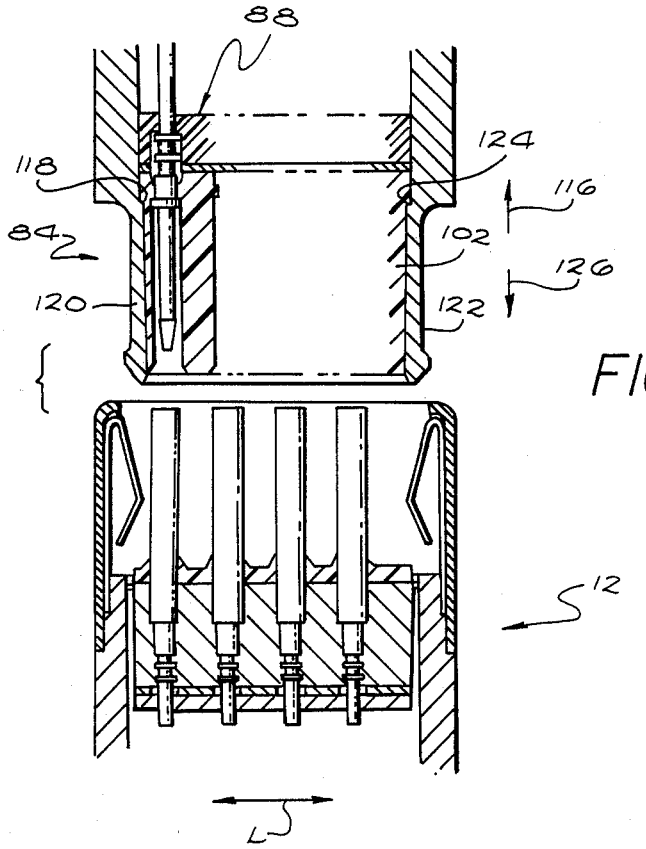
FIG. 4 is a view taken on the line 4—4 of FIG. 3.

Although the position of the insert module 60 is closely controlled, it is still necessary that the module "float," by a distance such as 0.010 inch in a lateral direction (indicated by arrows L in FIG. 4). Such "floating" is necessary to enable the contacts 30 to align themselves with contacts 82 of a corresponding second connector 84 when the connectors mate, and to allow for displacement between the two connectors after mating, for example because of clamping of a heat sink. The ends **32*c* of the clips provide a low friction sliding surface. It is also necessary to allow the module to "float" by a distance such as 0.004 inch in a longitudinal direction (indicated by arrows M in FIG. 3) to allow contact alignment during mating. The ends 36, 38** of the clip can bend sufficiently to permit such longitudinal movement of the module.

The second connector 84 is formed with a shell 86 and an insert module 88 that include an insulative body 90 and the contacts 82 mounted in the body. The insert also includes a combined ground plane and retention clip 92 having a middle portion 94 lying facewise against faces 96, 98 of insulative layers 100, 102 of the insulative body. The clip also has ends or fingers 104, 106 preloaded outwardly against the shell and forming edges 108, 110 that can abut corresponding shoulders 112, 114 on the shell. In this embodiment of the invention, the abuttment of the clip ends against the shoulders prevents movement of the invert in a rearward direction 116 relative to the second connector 84. As shown in FIG. 4, one of the insulative layers 102 forms a pair of ledges 118 at its opposite longer side 120, 122 that abut corresponding shoulders 124 on the shell to prevent movement of the forward portion of the insert 88 in the forward direction 126.

Figure 5:
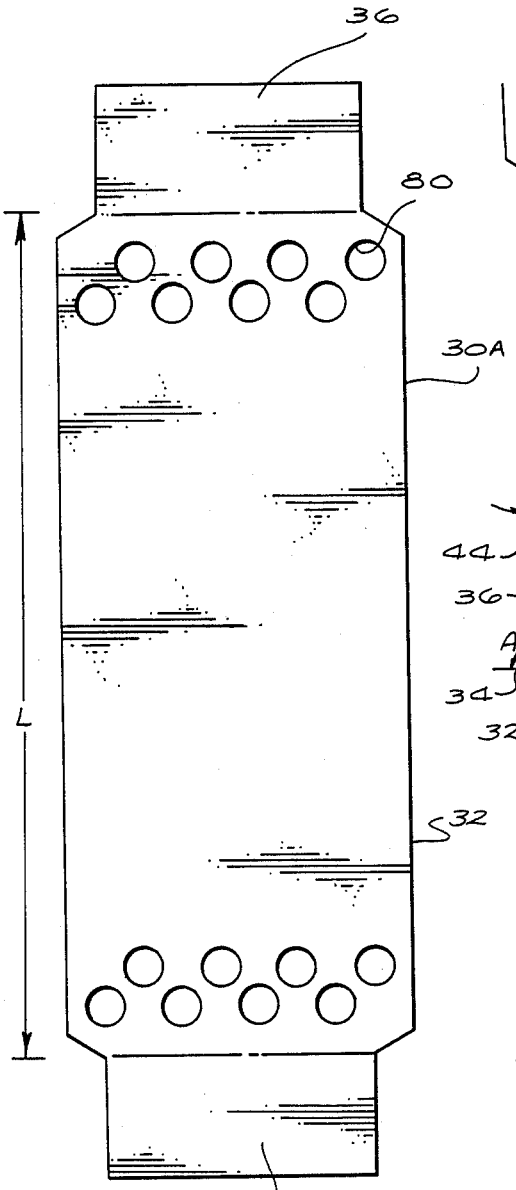
FIG. 5 is a plan view of the clip of FIG. 2, but showing it prior to bending of ends of the clip out of the plane of the middle.
Figure 6:
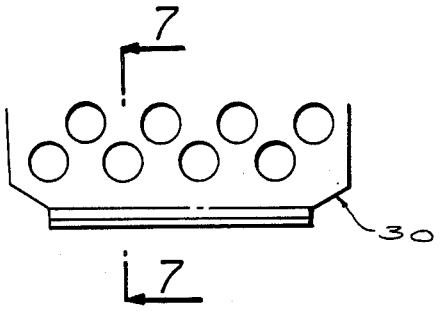
FIG. 6 is a partial plan view of the clip of FIG. 5, shown after bending of an end thereon.
Figure 7:
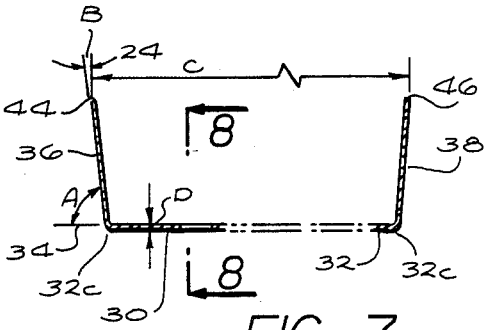
FIG. 7 is a view taken on the line 7—7 of FIG. 6.
Figure 8:
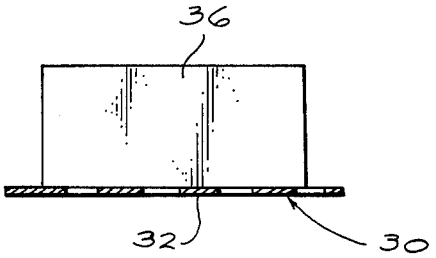
FIG. 8 is a view taken on the line 8—8 of FIG. 7.

FIGS. 5–8 illustrate details of a clip 30 constructed by applicant for a connector. FIG. 5 shows the configuration of the clip 30A prior to bending of the ends 36, 38 out of the plane of the middle portion 32. The middle portion is preferably substantially flat so its ends **32*c* lie substantially in a common plane 34, but it is possible to include bends in the clip middle portion. As shown in FIG. 7, the ends are bent at an angle A of 84° from the plane 34 of the middle clip portion, so that the ends extend at an angle B of 6° from the forward direction 24 and the edges 44, 46 are further spaced apart than the ends 32*c* of the middle portion. The length L of the middle portion 32 of the clip (at the outside of the bends connecting it to the ends) was 1,080 inches, while the length C between the outside of the ends was 1.116 inches. The distance between the surfaces 74, 76 (FIG. 3) against which the clip ends make contact, was separated by less than 1.116 inches, such as 1.088 inch to bend each clip end by about 14 mil (one mil equals one thousandth inch). This assures that the clip ends remain bent when located in the shell and can "float". The clip had a thickness D of 8 mil, and was constructed of stainless steel. It was formed with eighty perforations 80 for use with a module-insert having that number of contacts. The particular shell 12 (FIG. 1) had four spaces 22** to receive four of such module inserts.

Thus, the invention provides a clip for use in a connector, which serves several functions, all in a simple and reliable construction. The clip has a middle portion which bears against an insulative body that holds contacts, and has ends that couple to the connector shell. The insulative body and contacts may be part of an insert assembly that is designed to be readily removed and replaced in the connector shell. The clip ends are bent by more than 60° and preferably close to (within 15° of) 90° from the clip middle portion, with the middle portion preferably lying substantially in a plane. The clip ends form edges that can abut corresponding shoulders on the shell to prevent removal of the clip and the insulative body coupled thereto. The clip ends are preferably preloaded so they are slightly bent when installed in the shell, to insure contact with the shell so as to ground the clip to the shell. The clip preferably covers most of the space within the shell to provide an electromagnetic interference shield. It may be noted that the multiple holes in the clip through which contacts extend are of small size and prevent the passage of most electromagnetic energy past the clip. Where each contact is a coaxial contact, the outer conductor of each contact can be directly soldered to the interference shield. The bent ends of the clip can bend slightly more, to permit the module to "float" so as to move longitudinally by a small amount which is necessary to permit mating of contacts of a pair of connectors. The clip ends can also slide to permit the module to "float" laterally. In one embodiment of the invention, the ends of the clip middle portion bear against another pair of shoulders formed on a shell which extend further inwardly than the shoulders against which the edges of the clip ends bear. In such a construction, the clip prevents movement of the insulative body in both forward and rearward directions.

Although particular embodiments of the invention have been described and illustrated herein, it is recognized that modifications and variations may readily occur to those skilled in the art and consequently it is intended to cover such modification and equivalents.

What is claimed is:

1. A connector comprising:

a body of insulative material;

a metal shell extending around said body, said shell having opposite sides and forming an internal shoulder at each said side;

said body being removably mounted in said shell;

a plurality of contacts lying in said body;

a metal clip within said shell extending between said oposite sides of said shell, said clip having a middle portion lying substantially in a predetermined plane and attached to said body, and said clip having a pair of opposite ends bent out of said plane, said opposite ends having edges that abut said shoulders of said shell to releasably retain said clip and said body in said shell.

2. The connector described in claim 1 wherein:

said shell defines a mating direction along which it can mate with another connector and forms a space within the shell which has a cross-sectional area when viewed along said mating direction;

said clip covers most of the cross-sectional area of said space, but has holes through which said contacts extend.

3. A connector comprising:

a body of insulative material;

a metal shell extending around said body, said shell having opposite sides and forming a first shoulder at each side;

said shell having a second shoulder at each of said sides, said first shoulders both facing in a predetermined first direction and said second shoulders facing in a second direction substantially opposite to said first direction;

a plurality of contacts lying in said body;

a metal clip extending between said opposite sides of said shell, said clip having a middle portion lying substantially in a predetermined plane and against said body, and said clip having a pair of opposite ends bent out of said plane, said opposite ends having edges that abut said first shoulders of said shell; and said clip middle portion having opposite end portions which rest against said second shoulders.

4. The connector described in claim 3 wherein:

said clip is attached to said body.

5. A connector comprising:

a body of insulative material a metal shell extending around said body, said shell having opposite sides and forming a shoulder at each side;

a plurality of contacts lying in said body;

a metal clip extending between said opposite sides of said shell, said clip having a middle portion lying substantially in a predetermined plane and against said body, and said clip having a pair of opposite ends bent out of said plane, said opposite ends having edges that abut said shoulders of said shell;

said opposite ends of said clip being each bent by more than 60° but less than 90° out of the plane of said middle portion, so said opposite edges of said clip ends are spaced apart by more than the length of said clip middle portion; and said shell having slots at said opposite sides extending across locations otherwise occupied by said shoulders, whereby to enable reception of a tool to move said clip ends together and off said shoulders to remove the clip.

6. In a connector which includes a metal shell having a forward end, a body of insulative material within the shell, and a plurality of contacts lying within the body and having forward ends for mating with the terminals of a second connector, the improvement wherein:

said body is removably mounted in said shell;

said shell has a pair of opposite sides and forms an internal shoulder at each said side facing in predetermined first substantially vertical direction when said shell is oriented with said opposite sides horizontally spaced;

a clip formed of sheet metal and having a middle portion coupled to said body of insulative material, said clip having opposite clip ends that are each bent by more than 60° but less than 90° from a corresponding end of said middle portion, said clip ends each forming an edge abutting a different one of said shoulders to releasably retain said clip and said body in said shell.

7. In a connector which includes a metal shell having a forward end, a body of insulative material within the shell, and a plurality of contacts lying within the body and having forward ends for mating with the terminals of a second connector, the improvement wherein;

said shell has four sides including a first pair of opposite sides and a second pair of opposite sides;

a first shoulder at each side of each first pair of opposite sides facing in predetermined first substantially vertical direction when said shell is oriented with said opposite sides of said first pair horizontally spaced;

a second shoulder at each side of said second pair of opposite sides facing in a vertical direction opposite to said first direction;

a clip formed of sheet metal and having a middle portion coupled to said body of insulative material, said clip having opposite clip ends that are each bent by more than 60° but less than 90° from a corresponding end of said middle portion, said clip ends each forming an edge abutting a different one of said first shoulders; and said body of insulative material forming a pair of ledges that abut said second shoulders.

8. A connector comprising:

a shell having four sides, and forming a pair of shoulders at two opposite sides of said four sides, said shoulders facing in a predetermined rearward direction;

an insert module which includes a body of insulative material having opposite sides, a plurality of contacts in said body, and a clip, said clip having a middle portion in said module and opposite ends projecting primarily forwardly from said opposite sides of said body, said clip having extreme ends forming edges that substantially abut said shoulders to limit forward movement of said module.

9. The connector described in claim 8 wherein:

said clip and shell are each constructed of electrically conductive material, and said clip middle portion extends over most of the space between said shell four sides;

said clip ends each are bent at less than 90° from an imaginary plane with respect to said middle portion, and said clip ends are resilient;

said shell forms a pair of clip-engaging surfaces immediately rearward of said shoulders, and said clip ends are preloaded in bending so thay press against said clip-engaging surfaces.

10. The connector described in claim 8 wherein:

said clip middle portion has opposite end portions and said clip ends have edges spaced apart by more than said end portions of said clip middle portion;

said shell has a second pair of shoulders spaced rearward and inward of said first mentioned shoulders, and said end portions of said clip middle portion lie on said second shoulders.

11. The connector described in claim 8 wherein:

said shell has slots in said two opposite sides that extend to locations outward and rearward of said shoulders, whereby to facilitate removal of the clip.

* * * * *